US005887870A

United States Patent [19]

Kumabe et al.

[11] Patent Number: 5,887,870

[45] Date of Patent: Mar. 30, 1999

[54] MEDAL GAME MACHINE

[75] Inventors: Takashi Kumabe, Suginami-ku; Takashi Hamano, Kawasaki; Isao Uehara, Zama; Takumi Kikuya, Yokohama, all of Japan

[73] Assignee: Konami Co., Ltd., Hyogo-ken, Japan

[21] Appl. No.: 841,506

[22] Filed: Apr. 23, 1997

Related U.S. Application Data

[62] Division of Ser. No. 709,956, Sep. 9, 1996, Pat. No. 5,667, 218.

[30] Foreign Application Priority Data

Sep. 12, 1995 [JP] Japan ..... 7-258291

[51] Int. Cl.[6] ..... A63F 7/02

[52] U.S. Cl. ..... 273/138.3; 273/138.1

[58] Field of Search ..... 273/138.1, 138.3, 273/138.4, 144 R, 459, 460

[56] References Cited

U.S. PATENT DOCUMENTS

| | | | |
|---|---|---|---|
| 5,297,816 | 3/1994 | Becchio | 273/138.3 |
| 5,326,108 | 7/1994 | Faith . | |
| 5,507,490 | 4/1996 | Hagiwara | 273/138.3 |
| 5,713,572 | 2/1998 | Hagiwara | 273/138.3 |

FOREIGN PATENT DOCUMENTS

| | | |
|---|---|---|
| 2114452 | 8/1983 | United Kingdom . |
| 2226766 | 7/1990 | United Kingdom . |
| 2252735 | 8/1992 | United Kingdom . |

OTHER PUBLICATIONS

Play Meter, "Crompton Pushers", vol. 18, No. 2, Directory 1992.

*Primary Examiner*—William M. Pierce
*Attorney, Agent, or Firm*—Jordan and Hamburg LLP

[57] ABSTRACT

A medal game machine has a fixed table for placing medals thereon, a medal acquisition opening defined alongside of the fixed table and communicating with a medal outlet slot accessible by the player, a pusher table for pushing a medal on the fixed table toward the medal acquisition opening, and a supply mechanism for supplying medals onto the fixed table. The supply mechanism includes a turntable for placing medals thereon, a drive mechanism for rotating the turntable, a medal supply mechanism for supplying medals onto the turntable, and a transfer mechanism for transferring medals from the turntable onto the fixed table.

3 Claims, 13 Drawing Sheets

MEDAL GAME MACHINE

This is a division of application Ser. No. 08/709,956, filed Sep. 9, 1996 U.S. Pat. No. 5,667,218.

BACKGROUND OF THE INVENTION

1. Field of the Invention

The present invention relates to a medal game machine for guiding a medal on a fixed table with a movable pusher table through a medal acquisition opening into a medal outlet slot in order to compete for acquired medals.

2. Description of the Prior Art

Known medal game machines are disclosed in Japanese unexamined utility model publication No. 7-13392 and Japanese unexamined patent publication No. 7-116335, for example. These disclosed medal game machines comprise an upstanding game panel, a horizontal panel disposed underneath the game panel, and a pusher table mounted slidably on the horizontal panel. In operation, the pusher pushes a medal on the horizontal panel into a discharge slot, thereby allowing the player to acquire the medal. More specifically, when the player inserts a medal through a medal insertion slot into the game panel, the medal drops through the game panel onto the horizontal panel. The medal will be pushed by the pusher in different fashions depending on the position in which the medal drops through the game panel, the time at which the medal drops through the game panel, and the position in which the medal is placed on the horizontal panel. The player adjusts these positions and the time in an attempt to acquire as many medals as possible with the pusher.

Each time a medal passes through the medal insertion slot or the game panel, a roulette or a numerical display unit successively changes its displayed numerical value, and a large number of medals are introduced into the game panel depending on the displayed numerical value which has come to a stop. In the medal game machine disclosed in Japanese unexamined patent publication No. 7-116335, each time the roulette stops at a given position, a medal is supplied to a medal reservoir placed in a position that is visually recognizable by the player, and the medals pooled in the medal reservoir are introduced altogether into the game panel when a predetermined number of medals have been supplied to the medal reservoir.

Another conventional medal game machine having a medal reservoir, which is revealed in Japanese unexamined patent publication No. 6-285238, discharges all the medals in the medal reservoir onto the horizontal panel.

In the above conventional medal game machines, the medal reservoir is normally held in a still condition or is carried by a carriage and runs on a given track. Therefore, the medal reservoir fails to produce such a visual effect as to display many medals at all times and discharge them in a manner easily visually recognizable by the player for thereby motivating the player to acquire more medals.

Furthermore, the conventional medal game machines are of such a structure that the supply of medals into the game panel and the medal reservoir cannot be easily visually perceived by the player. Consequently, the conventional medal game machines fail to create such a visual effect as to supply a large number of medals in a manner easily visually recognizable by the player for thereby inciting the player to acquire more medals.

SUMMARY OF THE INVENTION

It is therefore an object of the present invention to provide a medal game machine which can supply or transfer medals in such a fashion as to produce visual and/or audio effects to motivate the player to acquire more medals.

According to the present invention, there is provided a medal game machine comprising a fixed table for placing medals thereon, a medal acquisition opening defined alongside of the fixed table and communicating with a medal outlet slot accessible by a player, pusher means for pushing a medal on the fixed table toward the medal acquisition opening, and supply means for supplying medals onto the fixed table, the supply means comprising a turntable for placing medals thereon, drive means for rotating the turntable, medal supply means for supplying medals onto the turntable, and transfer means for transferring medals from the turntable onto the fixed table.

The medal game machine further comprises a medal insertion slot for the player to insert a medal therethrough, and guide means for guiding the medal inserted through the medal insertion slot onto the fixed table.

The transfer means comprises decision means for determining an event to be carried out upon passage of a medal through a predetermined position, and means for transferring the medals from the turntable onto the fixed table in response to the determination of the event by the decision means. The transfer means further comprises medal detecting means disposed in a medal path from the fixed table to the medal acquisition opening, for detecting passage of the medal through the medal path, and indicia display means for displaying a plurality of indicia, successively changing the displayed indicia in response to a detected signal from the medal detecting means, and randomly stopping the displayed indicia, the decision means comprising means for deciding whether the stopped indicia displayed by the indicia display means comprise a predetermined combination of indicia or not. The medal detecting means is disposed in a position spaced from an edge of the fixed table and disposed in the medal acquisition opening. The medal game machine further comprises a cantilever extending from the edge of the fixed table into the medal acquisition opening, the medal detecting means being mounted on the cantilever. The cantilever comprises a first slanted surface extending obliquely upwardly from the edge of the fixed table, and a second slanted surface extending obliquely downwardly from the first slanted surface, the medal detecting means comprising a sensor for detecting a medal which passes on the second slanted surface.

The medal game machine further comprises indicator means for indicating to the player the passage of the medal detected by the medal detecting means.

The medal supply means has a medal supply opening positioned above turntable. The medal supply means comprises a vertical hollow cylinder having a lower end positioned above the turntable, the medal supply opening being defined in the lower end, and rail means for supplying medals into the vertical hollow cylinder. The vertical hollow cylinder is transparent. The medal supply means further comprises a pole rotatably disposed in the vertical hollow cylinder for rotation about its own axis and having an end coaxially connected to the turntable, and a plurality of plates fixed to the pole.

The transfer means comprises sorting means for selectively transferring medals on an outer circumferential portion of the turntable onto the fixed table. The sorting means comprises a limiting member mounted along the outer circumferential portion of the turntable for limiting movement of medals on the turntable.

The transfer means comprises a wall surrounding an outer circumferential edge of the turntable, the wall having at least one recess defined therein for allowing a medal to pass therethrough, and a gate openably closing the recess.

The medal game machine further comprises an upstanding wall disposed adjacent to the fixed table, the upstanding wall having a slit defined therein for passing therethrough one medal at a time from the fixed table, and a medal retriever for retrieving medals from the fixed table through the slit, the medal retriever being connected to the medal supply means. The upstanding wall has a cavity defined therein and extending upwardly from a corner between the fixed table and the upstanding wall, further comprising a panel covering at least an upper portion of the cavity, the slit being defined by a portion of the cavity which remains uncovered. The slit is positioned so as to be substantially concealed by the panel from a view from the player. The medal game machine further comprises a limiting member mounted on the fixed table near the slit for limiting movement of medals on the turntable. The limiting member comprises a projection projecting upwardly from an upper surface of the fixed table by an adjustable distance.

According to the present invention, there is also provided a medal game machine comprising a fixed table for placing medals thereon, a medal acquisition opening defined alongside of the fixed table and communicating with a medal outlet slot accessible by a player, pusher means for pushing a medal on the fixed table toward the medal acquisition opening, and supply means for supplying medals onto the fixed table, the supply means comprising a vertical hollow transparent cylinder having a lower end positioned above the fixed table, and rail means for supplying medals into the vertical hollow transparent cylinder.

The supply means further comprises a pole rotatably disposed in the vertical hollow transparent cylinder for rotation about its own axis, and a plurality of plates fixed to the pole.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

As shown in FIGS. 1 through 7, a medal game machine according to the present invention has a machine housing 1 comprising a base 1*a* in the form of a hollow box, a rectangular control frame 1*b* mounted on the upper end of the base 1*a*, a support beam 1*c* extending horizontally over the control frame 1*b*, and a portal-shaped ornamental tower 1*d* supported on and extending upwardly from opposite ends of the support beam 1*c*.

The rectangular control frame 1*b* defines therein a game space 2 where a medal game will be played for acquiring medals, as described later on. A light-transmissive cover 3 is disposed between the control frame 1*b* and the support beam 1*c*.

Figure 3:
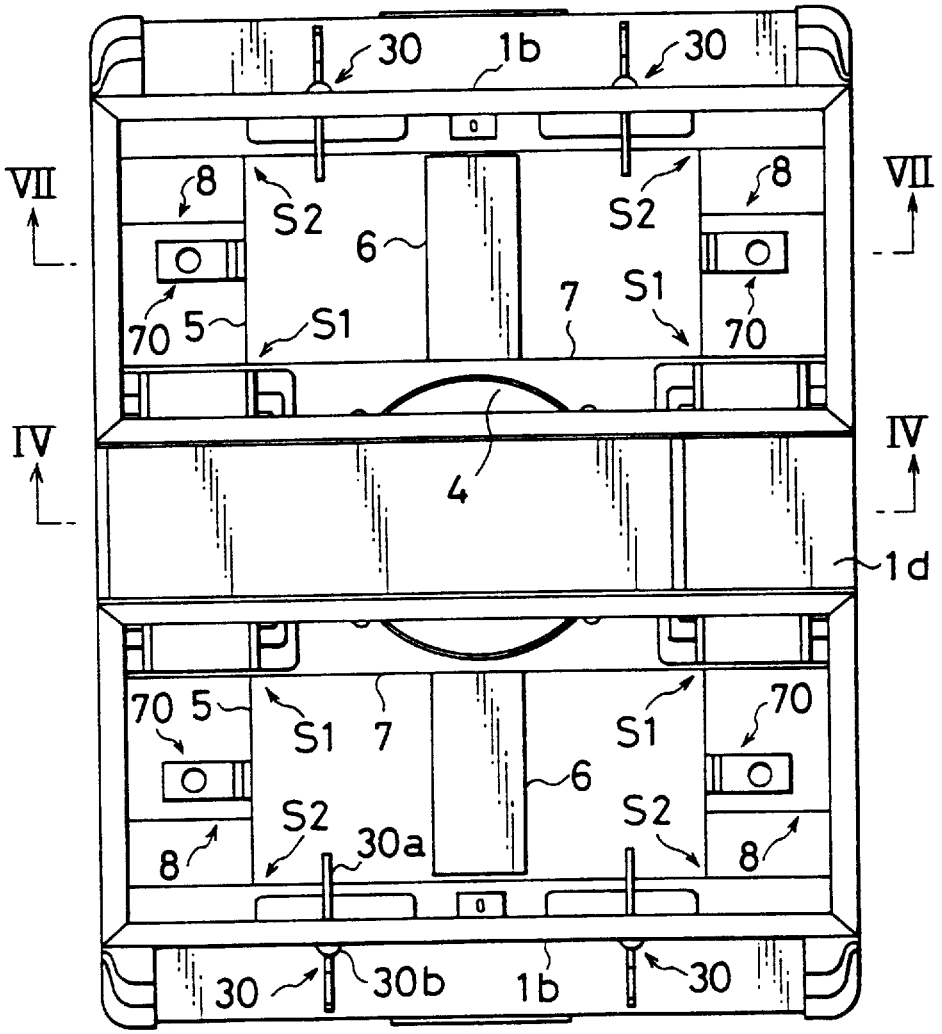
FIG. 3 is a plan view of the medal game machine.
Figure 4:
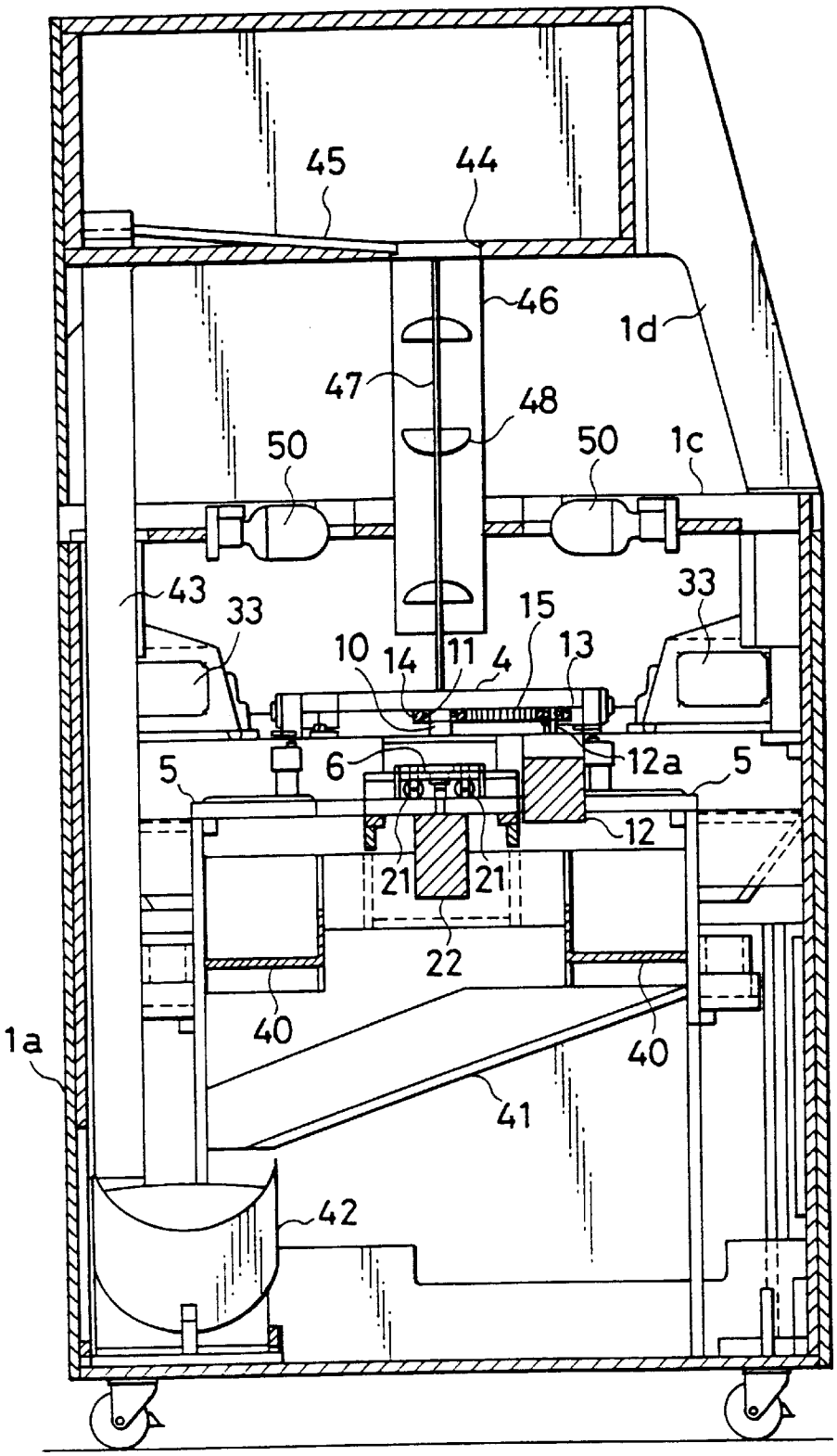
FIG. 4 is a cross-sectional view taken along line IV—IV of FIG. 3.
Figure 5:
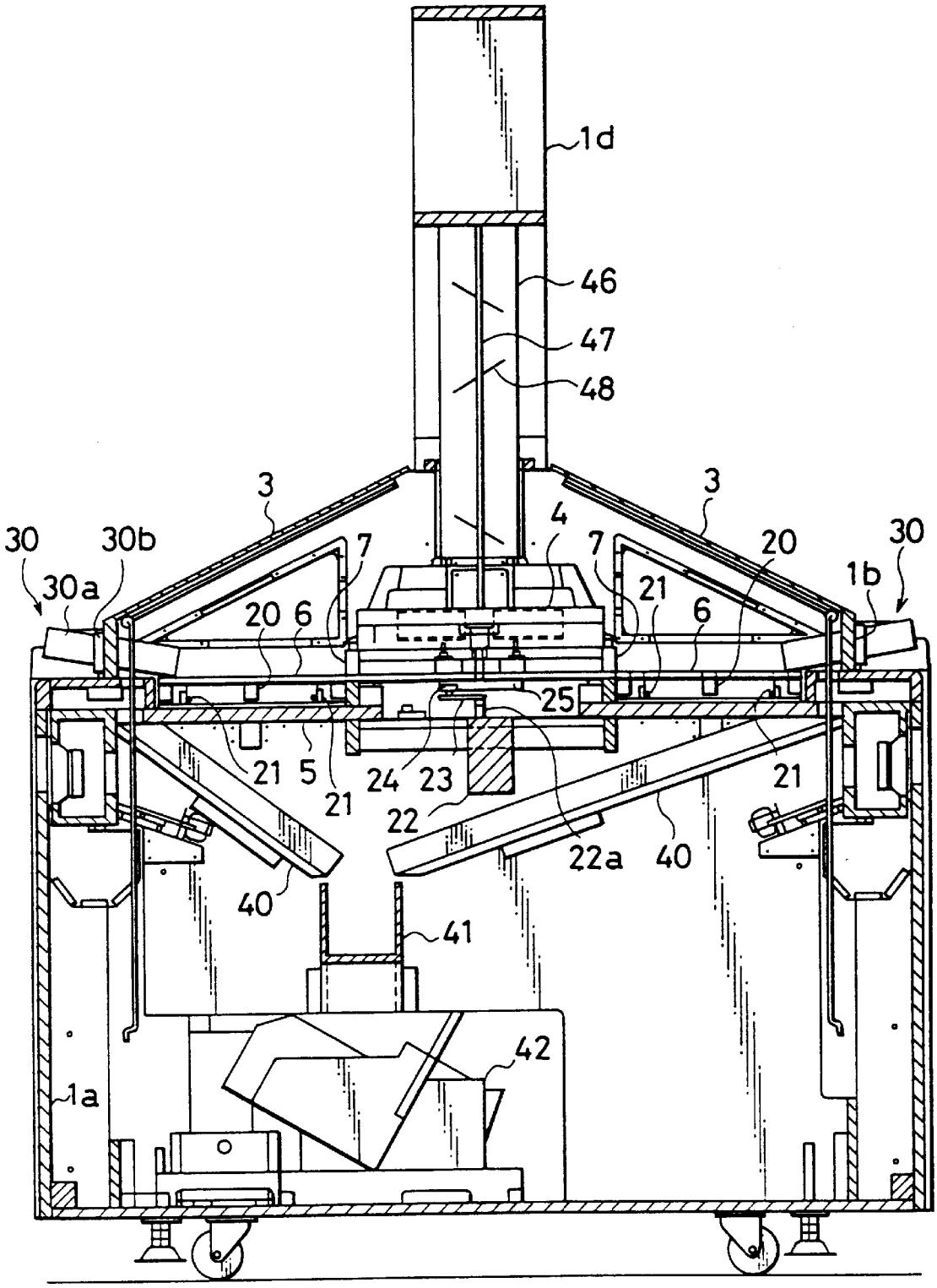
FIG. 5 is a cross-sectional view taken along line V—V of FIG. 2.
Figure 6:
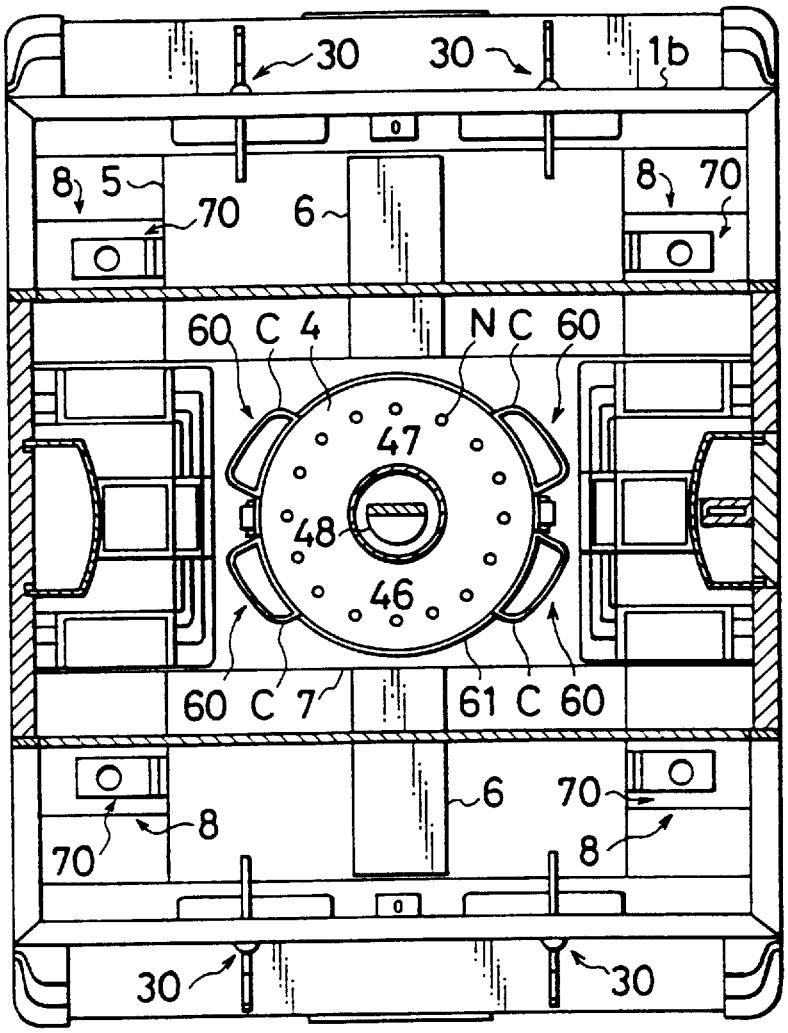
FIG. 6 is a cross-sectional view taken along line VI—VI of FIG. 2.
Figure 7:
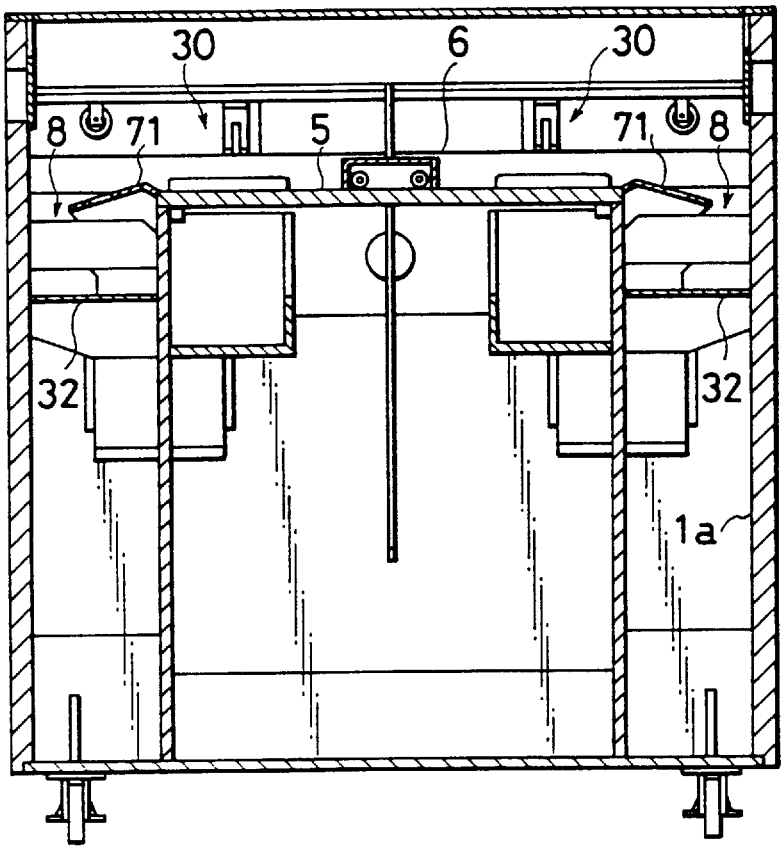
FIG. 7 is a cross-sectional view taken along line VII—VII of FIG. 3.

As shown in FIGS. 3 through 6, a disk-shaped turntable 4 is disposed centrally in the game space 2 above a pair of fixed tables 5 which are spaced horizontally from each other and positioned forwardly and rearwardly of the turntable 4 (shown as being above and below the turntable 4 in FIGS. 3 and 6). An elongate plate-like movable pusher table 6 extends below and across the turntable 4 and over the fixed tables 5, and has its longitudinal axis extending perpendicularly to the portal-shaped ornamental tower 1*d*. The pusher table 6 is horizontally movable in a vertical space between the turntable 4 and the fixed tables 5 in directions along the portal-shaped ornamental tower 1*d*. The pusher table 6 may be either slidable on the fixed tables 5 or movable with a small clearance over the fixed tables 5. The turntable 4 is mounted on a table mount 7 which projects upwardly of the pusher table 6.

As shown in FIG. 4, the turntable 4 is rotatably mounted by a bearing 11 on a vertical support shaft 10 which is supported in the base 1*a*. A drive motor 12 which is also supported in the base 1*a* has a vertical drive shaft 12*a* that supports a timing pulley 13 on its upper end. Another timing pulley 14 is fixed to a lower surface of the turntable 4 coaxially with the support shaft 10. A timing belt 15 is trained around these timing pulleys 13, 14. Therefore, when the drive motor 12 is energized, rotational drive forces from the drive motor 12 are transmitted through the timing pulley 13, the timing belt 15, and the timing pulley 14 to the turntable 4, thereby rotating the turntable 4 about its own axis. As described later on, a number of medals will be supplied onto the turntable 4.

As shown in FIG. 6, a plurality of bolts N are mounted on and project upwardly from an upper surface of the turntable 4 at equal circumferentially spaced intervals at a given radial distance from the central axis of the turntable 4. The number of the bolts N and the distance by which they project upwardly from the upper surface of the turntable 4 are determined such that, of medals supplied onto the turntable 4, those medals which are positioned in a range surrounded by heads of the bolts N will not move radially outwardly beyond the bolts N, and more preferably such that a single layer of those medals which are held in direct contact with the turntable 4 will not move radially outwardly beyond the bolts N, but other medals positioned on that single layer of medals will move radially outwardly beyond the bolts N.

Therefore, the bolts N serve to selectively transfer those medals on an outer circumferential portion of the turntable 4 onto the fixed tables 5.

Instead of the bolts N, a ring-shaped wall may be mounted concentrically on the turntable 4, or the turntable 4 may have an annular step extending along an outer circumferential edge of the turntable 4 and higher than a circular area of the turntable 4 which is surrounded by the annular step.

Alternatively, an arm or arms may be angularly movably mounted on the turntable 4 for selectively transferring medals on the turntable 4 onto the fixed tables 5.

As shown in FIGS. 3 and 6, medal acquisition openings 8 are defined in the base 1*a* on opposite sides of each of the fixed tables 5 and communicate with medal outlet slots 31 (see FIGS. 1 and 2), which will be described later on.

As shown in FIG. 5, the pusher table 6 extends through a lower portion of the table mount 7. As shown in FIG. 4, the pusher table 6 is of an inverted channel-shaped cross section comprising a horizontal plate and a pair of walls projecting downwardly from respective opposite sides of the horizontal plate. The walls have their lower ends either held in slidable contact with the upper surfaces of the fixed tables 5 or spaced slightly from the upper surfaces of the fixed tables 5 by a clearance which is preferably small enough not to allow medals to pass therethrough.

As shown in FIG. 5, the pusher table 6 is movably supported by horizontal guides 20 disposed in a position below the table mount 7 and extending perpendicularly to the sheet of FIG. 5, for horizontal movement on the fixed tables 5. As shown in FIGS. 4 and 5, rollers 21 are rotatably supported on the pusher table 6 in rolling contact with the fixed tables 5 for thereby allowing the pusher table 6 to move horizontally smoothly with reduced frictional resistance. The horizontal guides 20 and the rollers 21 are vertically adjusted in position so as to keep the lower ends of the walls of the pusher table 6 in slidable contact with the upper surfaces of the fixed tables 5 or spaced slightly from the upper surfaces of the fixed tables 5.

As shown in FIGS. 4 and 5, a drive motor 22 is mounted in the base 1*a* underneath the pusher table 6 and has a drive shaft 22*a* projecting upwardly with a rotatable arm 23 being fixed to the drive shaft 22*a*. A roller 24 is rotatably supported on a distal end of the rotatable arm 23 and movable along an elongate guide 25 extending longitudinally along the pusher table 6. When the drive motor 22 is energized, the drive shaft 22*a* rotates the rotatable arm 23, causing the roller 24 to move reciprocally along the guide 25 thereby to move the pusher table 6 reciprocally to the left and right in FIGS. 3 and 4. The pusher table 6 is thus reciprocally moved toward and away from the medal acquisition openings 8 over a stroke which is determined by the position in which the roller 24 is mounted on the rotatable arm 23.

As shown in FIG. 6, four gate mechanisms 60 which are identical to each other are mounted on an outer circumferential edge of the turntable 4 at angularly spaced intervals for discharging medals on the turntable 4 onto the fixed tables 5. The turntable 4 also has an annular wall 61 projecting upwardly from the outer circumferential edge thereof for preventing medals from being expelled radially outwardly off the turntable 4 under centrifugal forces when the turntable 4 rotates. The annular wall 41 has four recesses defined therein in alignment with the respective gate mechanisms 60. Therefore, when the gate mechanisms 60 are open while the turntable 4 is in rotation, medals on the turntable 4 are discharged from the turntable 4 through the recesses in the annular wall 41 into the gate mechanisms 60, as described later on.

Figure 8:
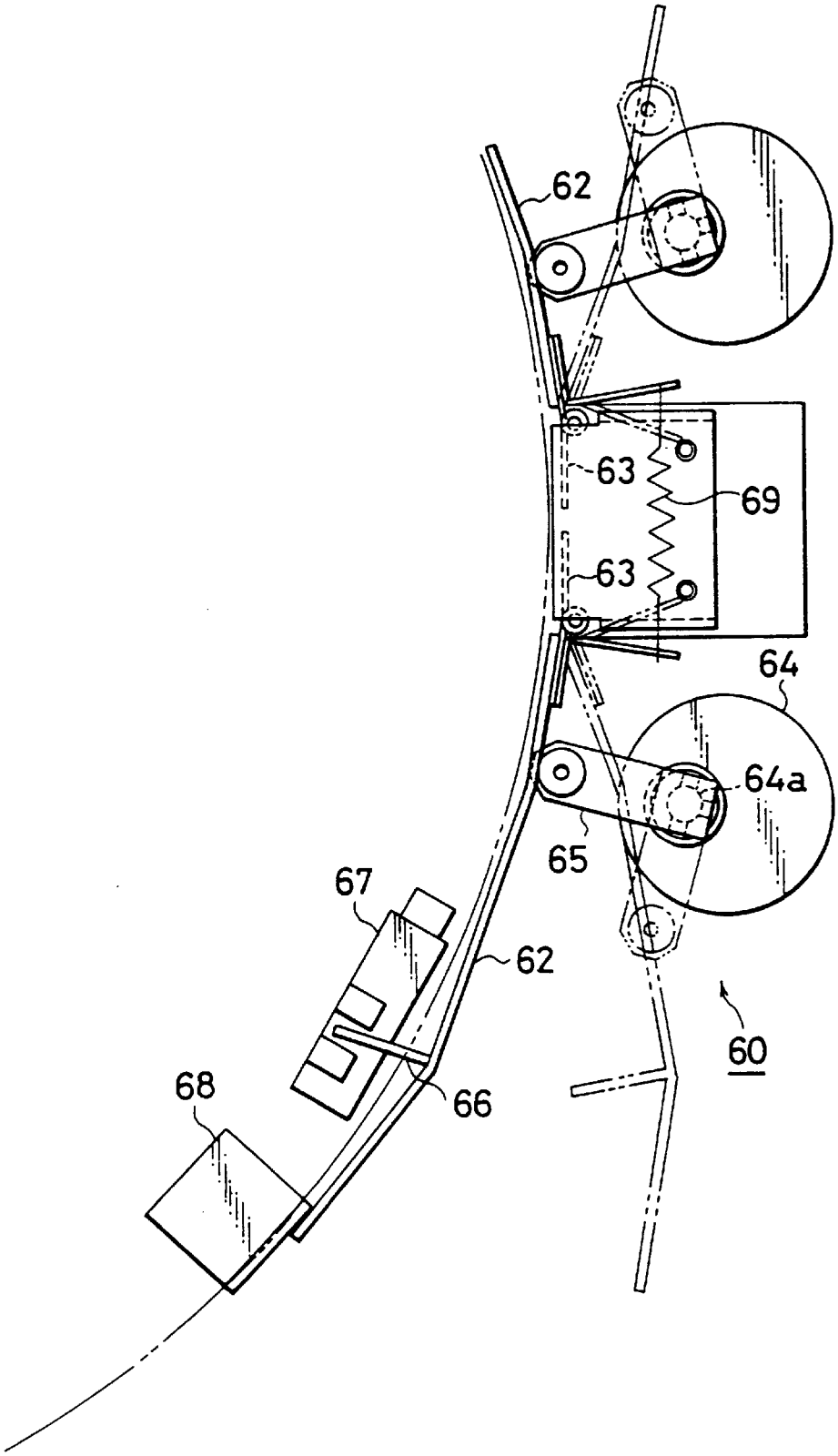
FIG. 8 is a plan view of a gate mechanism of the medal game machine.
Figure 9:
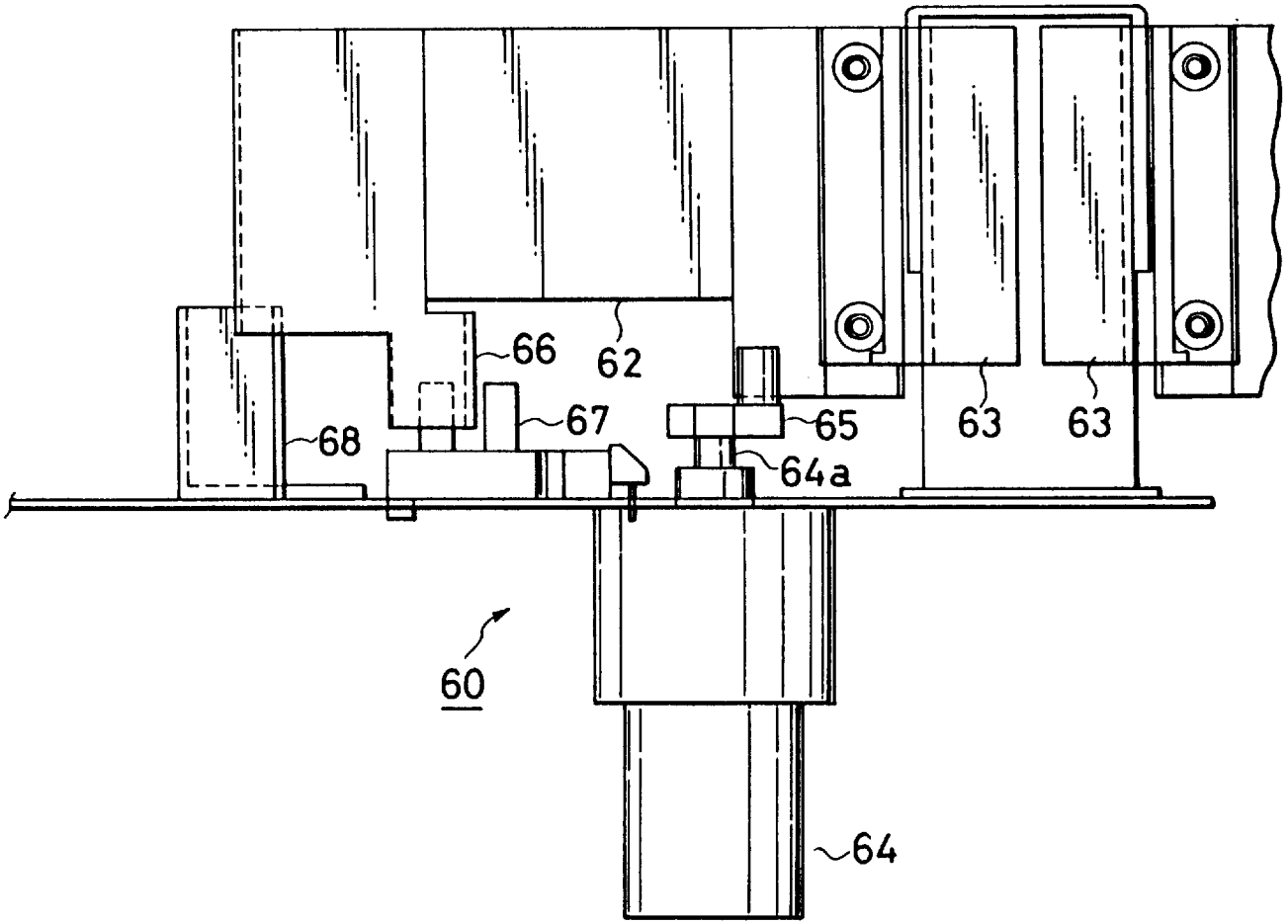
FIG. 9 is a side elevational view of the gate mechanism.

Each of the gate mechanisms 60 will be described in detail below with reference to FIGS. 6, 8, and 9. As shown in FIGS. 8 and 9, each of the recesses defined in the annular wall 61 is covered with a gate plate 62 which is openably and closably supported by a hinge 63. A drive motor 64 for opening and closing the gate plate 62 has a drive shaft 64*a* with a crank 65 fixed to an upper end of the drive shaft 64*a*. The crank 65 has a distal end connected by a pin to an outer surface of the gate plate 62. When the drive motor 64 is energized to angularly move the crank 65 through a predetermined angle, the gate plate 62 is angularly moved radially outwardly about the hinge 63, opening the recess defined in the annular wall 61 as indicated by the imaginary lines in FIG. 8.

Figure 15:
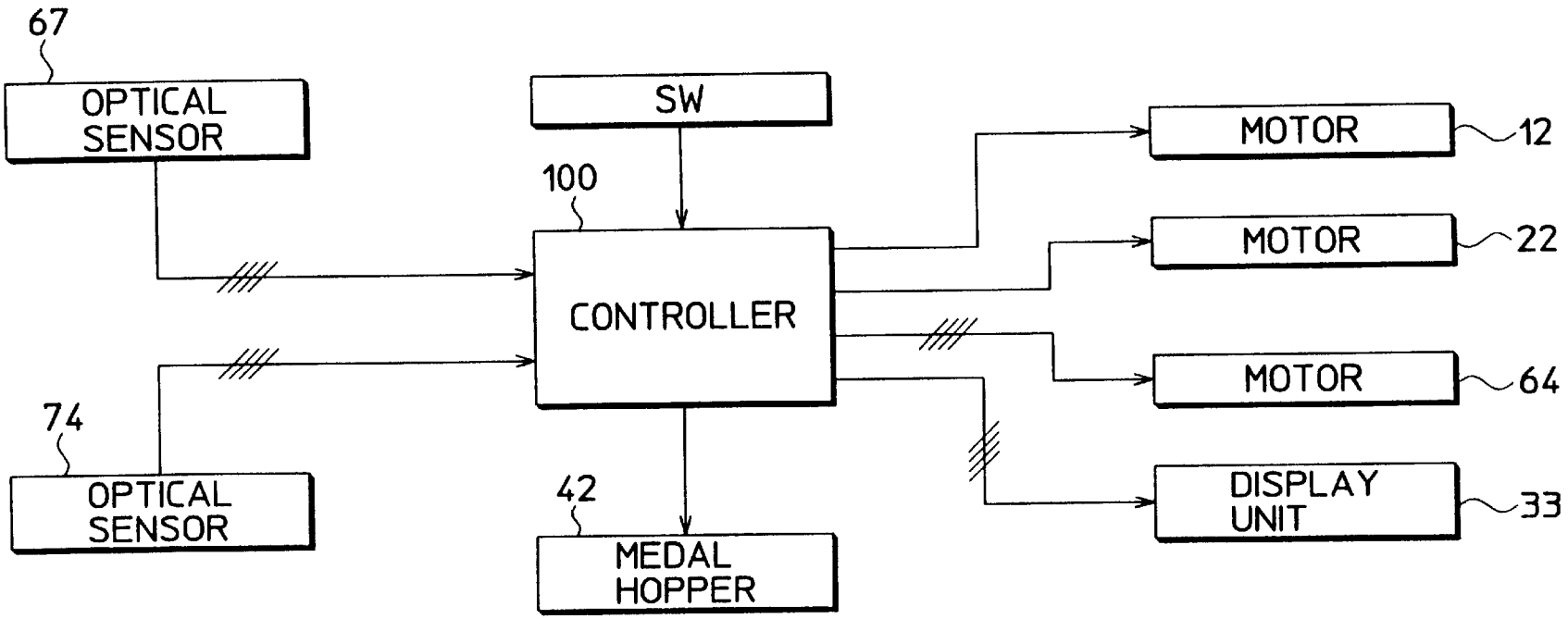
FIG. 15 is a block diagram of a control system of the medal game machine.

As shown in FIG. 8, a shield plate 66 projects radially inwardly of the turntable 4 from a central potion of the gate plate 62. When the gate plate 62 is in a closed position indicated by the solid lines in FIG. 8, the shield plate 66 is positioned so as to block an optical path of an optical sensor 67 mounted on the turntable 4. Therefore, when the gate plate 62 is in an open position as indicated by the imaginary lines in FIG. 8, the shield plate 66 is retracted out of the optical path of the optical sensor 67, which then detects the opening of the gate plate 62. The optical sensors 67 of the respective gate mechanisms 60 are electrically connected to a controller 100 (see FIG. 15) of the medal game machine. The optical sensors 67 are collectively shown as a single optical sensor 67 in FIG. 15. The tip end of the gate plate 62 is engaged by a stopper 68 mounted on the turntable 4 when the gate plate 62 is in the closed position.

The optical sensor 67 may be replaced with an ultrasonic proximity sensor for emitting an ultrasonic wave and detecting a ultrasonic wave reflected by the shield plate 66, a microswitch having a movable contact triggerable by the shield plate 66, or a flux change sensor such as a Hall-device sensor which can be actuated by a medal if the medal is made of a magnetic material.

As shown in FIG. 6, the four gate mechanisms 60 are grouped into two pairs of gate mechanisms 60 which are positioned in diametrically opposite relation to each other across the turntable 4. The gate mechanisms 60 in each of the pairs are oriented away from each other with their hinges 63 positioned adjacent to each other, i.e., are positioned symmetrically with respect to a horizontal line between these gate mechanisms 60 in FIG. 6. The gate plates 62 of the gate mechanisms 60 in each pair are interconnected by a helical compression spring 69 (see FIG. 8). When the crank 65 is not angularly moved by the drive motor 64, therefore, the gate plate 62 of each of the gate mechanisms 60 is urged into the closed position under the bias of the helical compression spring 69 and held in the closed position in abutment against the stopper 68.

As shown in FIG. 6, the gate mechanisms 60 are covered with respective covers C so that they cannot be directly seen by the player.

Medals on the turntable 4 may be transferred onto the fixed tables 5 positively or passively by any of various other mechanisms. For example, medals may be transferred altogether or successively from the turntable 4 onto the fixed tables 5 by gravity, a belt conveyor, a crane, etc., or may be blocked on the turntable 4 by some restriction thereon and then forced off the turntable 4.

As shown in FIGS. 1 through 7, the medal game machine has a plurality of medal insertion mechanisms 30 which are identical to each other. As better shown in FIGS. 3 and 6, there are four medal insertion mechanisms 30, two in a front portion of the medal game machine and two in a rear portion of the medal game machine. Since the medal insertion mechanisms 30 correspond to respective players, the illustrated medal game machine allows four players to play a medal game simultaneously.

The medal insertion mechanisms 30 are of a known nature and will not be described in detail below. Briefly, each of the medal insertion mechanisms 30 has a guide bar 30*a* (see FIG. 5) extending through an upstanding wall of the control frame 1*b* and having an outer end exposed outwardly and an opposite inner end extending over one of the fixed tables 5, and a swing support 30*b* by which the guide bar 30*a* is horizontally swingably supported. The guide bar 30*a* has a medal slot (not shown) defined therein for passage of a medal therethrough, and is supported by the swing support 30*b* obliquely downwardly from the outer and toward the inner and thereof. When the player inserts a medal into the medal slot in the guide bar 30*a* from the outer end thereof, the medal rolls or slides down the medal slot due to gravity from the outer end to the inner end of the guide bar 30*a*, and is discharged from the inner end of the guide bar 30*a* onto the fixed table 5. The guide bar 30*a* may be replaced with a rail for guiding metals therealong.

Each of the medal insertion mechanisms 30 may be combined with a medal sorting device such as the medal sorting device disclosed in Japanese patent application No. 6-252761, so that medals, tokens, coins, or the like which are different in dimension and shape from the medals used by the medal game machine according to the present invention will be returned to the medal outlet slot 31 by the medal sorting device. A medal sensor may be associated with each of the medal insertion mechanisms 30 for counting medals that are inserted by the player. The number of counted medals as well as the number of supplied medals (described later on) can be used as management data by the proprietor of the medal game machine.

Instead of the medal insertion mechanisms 30, a vertical game panel may be positioned above each of the fixed tables 5, the vertical game panel having a medal insertion slot defined in an upper portion thereof for inserting a medal to be supplied downwardly through the medal panel onto the fixed table 5. Alternatively, a mechanism may be used to forcibly eject a medal inserted by the player onto the fixed table 5.

Figure 1:
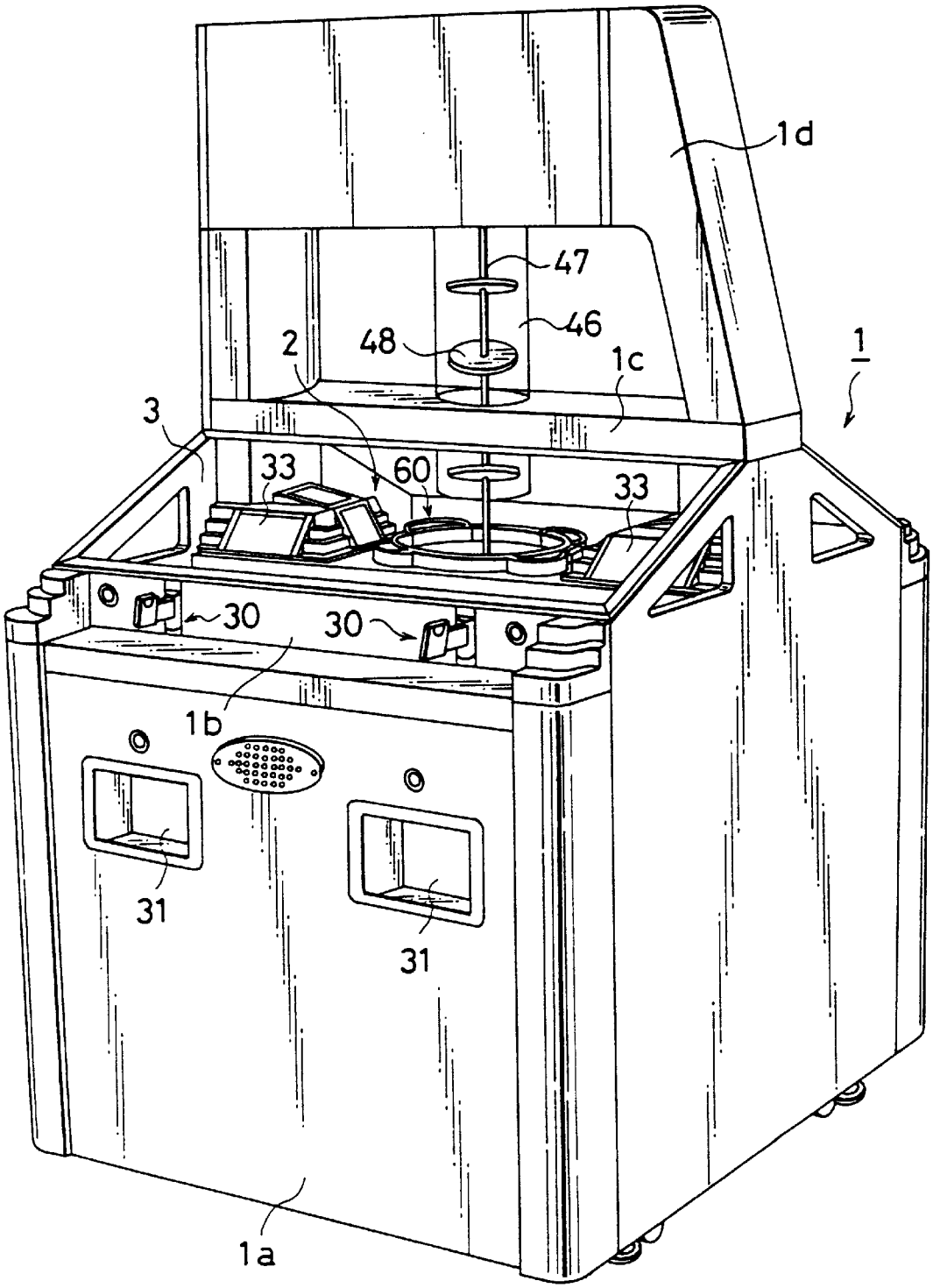
FIG. 1 is a perspective view of a medal game machine according to the present invention.
Figure 2:
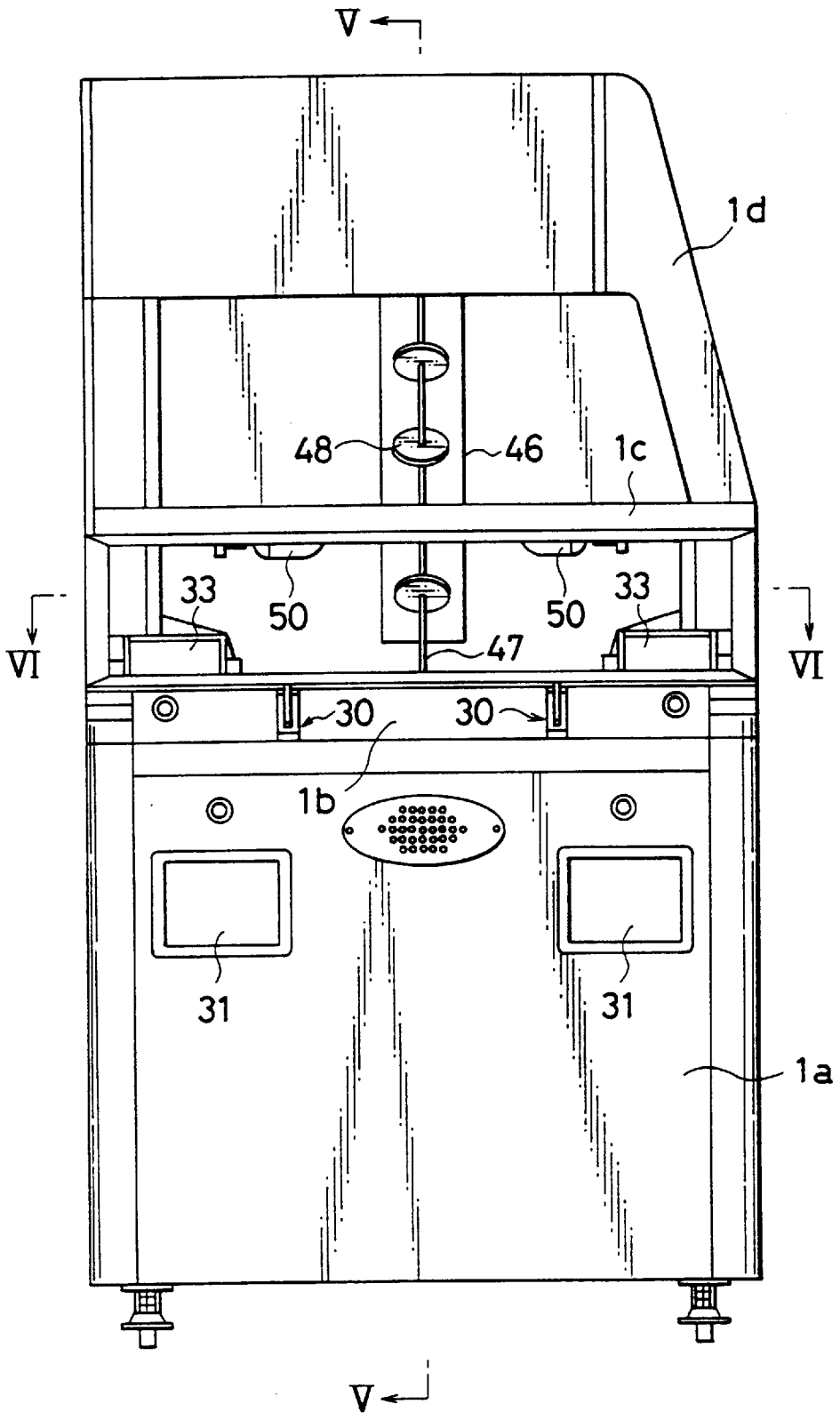
FIG. 2 is a front elevational view of the medal game machine.

As shown in FIGS. 1 and 2, the medal outlet slots 31 are defined in the base 1*a* below the respective medal insertion mechanisms 30. The medal outlet slots 31 are connected to respective medal chutes 32 (see FIG. 7) which have upper openings serving as the medal acquisition openings 8. Therefore, medals which have dropped from the fixed tables 5 into the medal acquisition openings 8 are guided through the medal chutes 32 into the medal outlet slots 31, from which the medals can be removed from the medal game machine. When the player manages to drop a medal from the fixed table 5 into the medal acquisition opening 8, the dropped medal is guided down the medal chute 32 into the medal outlet slot 31, and the player can pick up the medal as an acquired medal.

As shown in FIGS. 3 and 6, the medal game machine has four checker mechanisms 70 for initiating a jackpot operation or event (described later on) for the respective players of the medal game machine. Each of the checker mechanisms 70, which are identical to each other, will be described below with reference to FIGS. 10 and 11.

Figure 10:
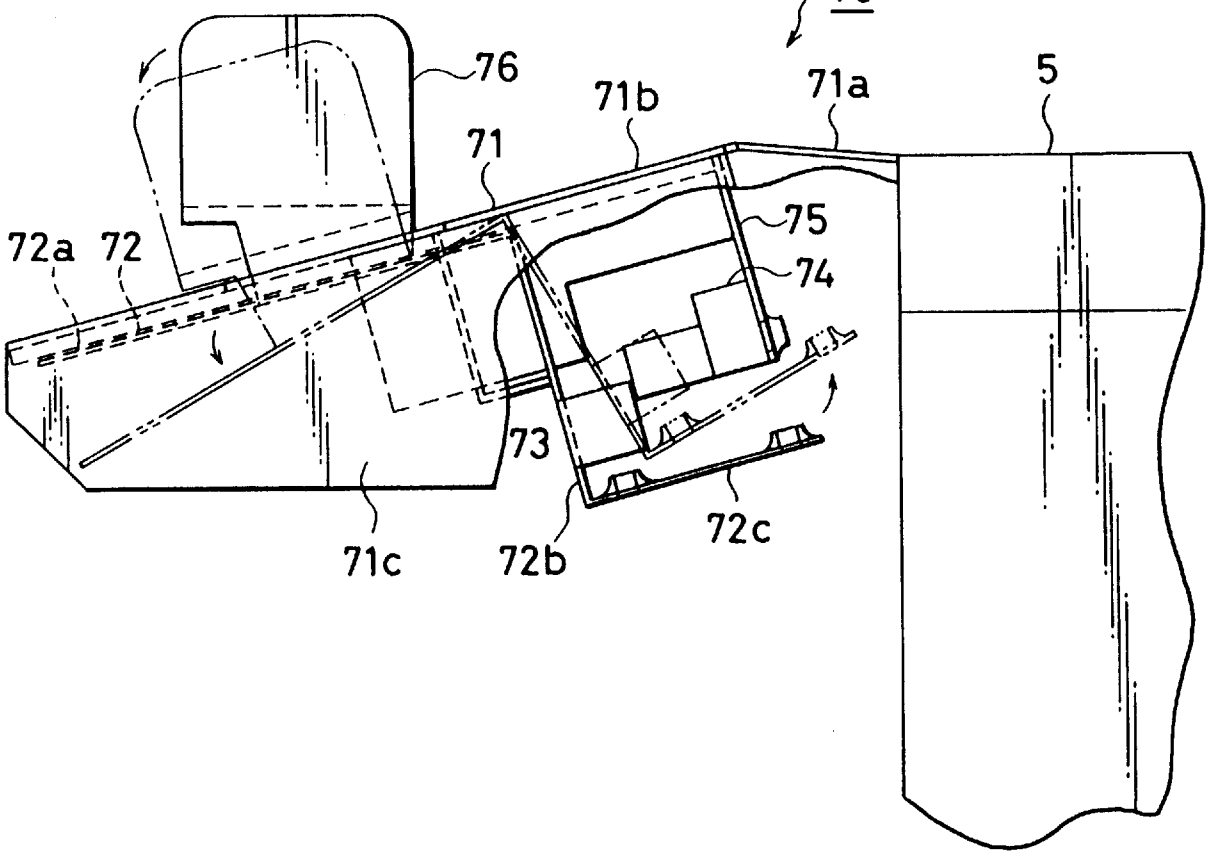
FIG. 10 is a front elevational view of a checker mechanism of the medal game machine.
Figure 11:
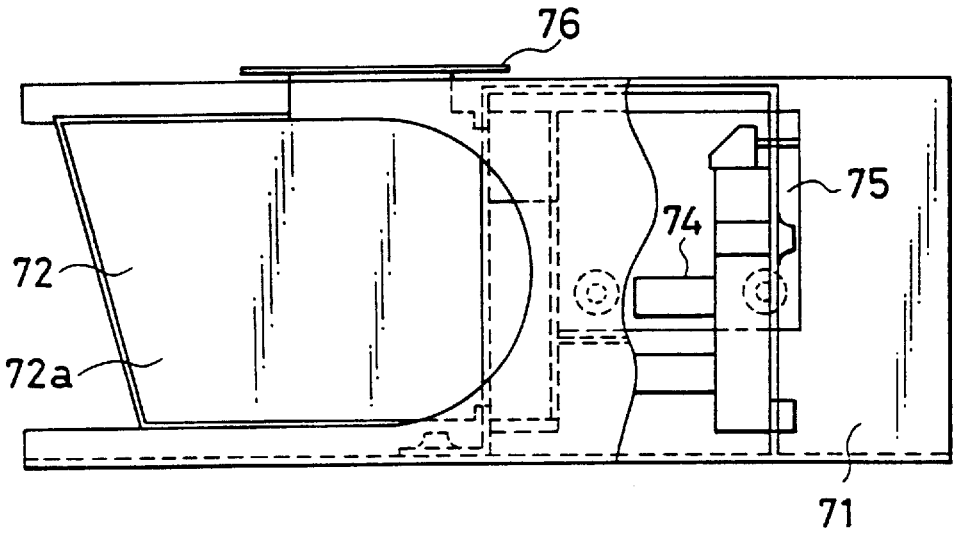
FIG. 11 is a plan view of the checker mechanism.

As shown in FIGS. 10 and 11, each of the checker mechanisms 70 comprises a cantilever 71 extending from an upper surface of the fixed table 5 toward a position above the medal acquisition opening 8. The cantilever 71 comprises an upwardly slanted plate 71*a* which extends obliquely upwardly in a direction from the upper surface of the fixed table 5 toward its tip end remote from the fixed table 5, a downwardly slanted plate 71*b* which extends obliquely downwardly in a direction from the tip end of the obliquely upward plate 71*a* toward its tip end, and a side plate 71*c* extending downwardly from side edges of the upwardly and downwardly slanted plates 71*a*, 71*b*.

As shown in FIG. 11, the downwardly slanted plate 71*b* has a large recess defined therein which extends from a central region thereof toward the tip end. The large recess defined in the downwardly slanted plate 71*b* is normally closed by a movable gate plate 72 that lies underneath the downwardly slanted plate 71*b* and is swingably supported by the cantilever 71 by a pivot shaft (not shown). As shown in FIG. 10, the gate plate 72 comprises a medal carrier 72*a* extending parallel to the downwardly slanted plate 71*b*, a vertical plate 72*b* extending downwardly from a rear end of the medal carrier 72*a* which is closer to the fixed table 5, and a rear plate 72*c* extending parallel to the downwardly slanted plate 71*b* from a lower end of the vertical plate 72*b* rearwardly toward the fixed table 5. When a medal is placed on the medal carrier 72*a*, the medal carrier 72*a* is angularly moved downwardly under the weight of the medal thereon.

As shown in FIG. 10, a shield plate 73 extends rearwardly from the vertical plate 72*b*. When the gate plate 72 is angularly moved to the imaginary position shown in FIG. 10 due to the weight of a medal placed on the medal carrier 72*a*, the shield plate 73 moves into and blocks an optical path of an optical sensor 74 which is mounted on a channel-shaped attachment 75 fixed to the side plate 71*c* of the cantilever 71. The optical sensor 74 detects the passage of the medal onto the downwardly slanted plate 71*b*, issuing a jackpot signal indicative of the start of a jackpot operation when the gate plate 72 is angularly moved to bring the shield plate 73 into the optical path of the optical sensor 74. The optical sensors 74 of the respective checker mechanisms 70 are electrically connected to the controller 100 (see FIG. 15). The optical sensors 74 are collectively shown as a single optical sensor 74 in FIG. 15. The optical sensors 74 may be positioned in other locations. For example, they may be positioned in medal paths extending from the medal insertion mechanisms 30 to the fixed tables 5, medal paths extending from the turntable 4 to the fixed tables 5, or medal paths extending from the fixed tables 5 to the medal acquisition openings 8. A plurality of such optical sensors 74 may be disposed in each of those medal paths.

The optical sensor 74 comprises a light-emitting element and a light-detecting element spaced from each other along the optical path. A light beam emitted from the light-emitting element toward light-detecting element can be blocked by the shield plate 73 when the shield plate 73 moves into the optical path of the optical sensor 74. The optical sensor 74 may be replaced with an ultrasonic proximity sensor for emitting an ultrasonic wave and detecting a ultrasonic wave reflected by the shield plate 73, a microswitch having a movable contact triggerable by the shield plate 73, or a flux change sensor such as a Hall-device sensor which can be actuated by a medal if the medal is made of a magnetic material.

A flag plate 76 rises upwardly from a side edge of the medal carrier 72*a* remote from the side plate 71*c* of the cantilever 71. The flag plate 76 serves to indicate the start of a jackpot operation to the player when the gate plate 72 is angularly moved under the weight of a medal that is placed on the medal carrier 72*a*. The flag plate 76 has a decorated side face for announcing a position representative of the start of a jackpot operation so that the player can easily recognize that a medal is placed on the medal carrier 72*a* and hence a jackpot operation will be initiated.

The flag plate 76 may be replaced with a lamp or a light-emitting device which is controlled to be turned on or flickered in response to a detected signal from the optical sensor 74, or a sound-generating device such as a loudspeaker which is controlled to generate a sound such as a fanfare sound in response to a detected signal from the optical sensor 74.

As shown in FIGS. 1, 2, and 4, the medal game machine has four display units 33 disposed in the game space 2 in association with the respective medal insertion mechanisms 30. Each of the display units 33 is electrically connected to the controller 100 (see FIG. 15) and is capable of displaying a three-figure numeral. Specifically, each of the display units 33 comprises an array of three seven-segment light-emitting diode (LED) display elements (not shown), each of which can independently be controlled for displaying numerals. Details of a process of controlling the display units 33 for displaying numerals will be described later on.

Each of the display units 33 may alternatively be replaced with a liquid crystal display unit, a cathode-ray tube (CRT), or a slot-machine display unit comprising at least one rotatable endless reel carrying numerals, letters, symbols, etc. Each of the display units 33 or its alternative equivalents is capable of displaying numerals, letters, symbols, etc.

As shown in FIG. 3, a total of eight slits S1, S2 are defined alongside of the fixed tables 5 for retrieving medals stacked on the fixed tables 5. Specifically, four slits S1 are defined between the table mount 7 and the fixed tables 5 at respective corners between the table mount 7 and the fixed tables 5, and four slits S2 are defined between walls of the control frame 1*b* and the fixed tables 5 at respective corners between the walls of the control frame 1*b* and the fixed tables 5.

Figure 12:
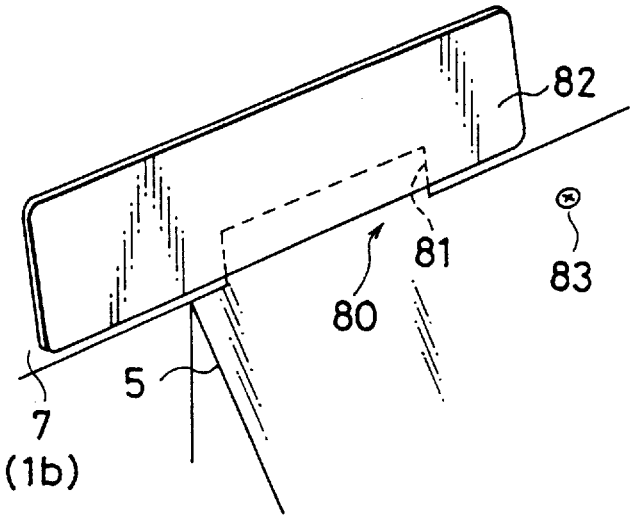
FIG. 12 is a perspective view of parts which define a slit defined alongside of a fixed table of the medal game machine.
Figure 13:
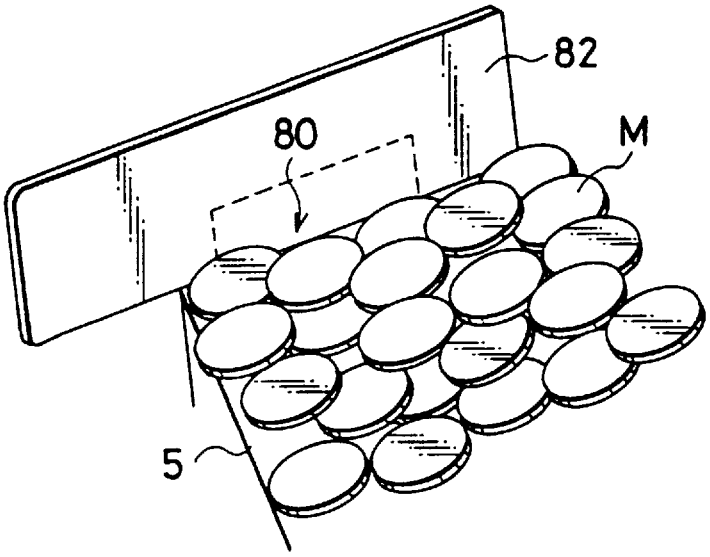
FIG. 13 is a perspective view of the parts which defines the slit with medals placed on the fixed table.
Figure 14:
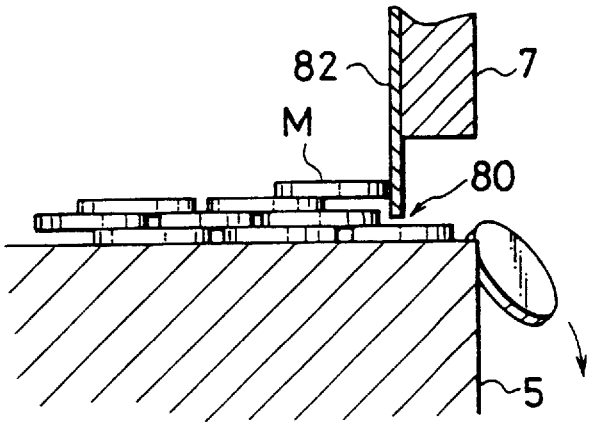
FIG. 14 is a cross-sectional view of the parts which defines the slit.

Each of the slits S1, S2 will be described in detail below with reference to FIGS. 12, 13, and 14. As shown in FIG. 12, an upstanding wall of the table mount 7 or an upstanding wall of the control frame 1*b* has a cavity 81 defined therein which extends upwardly from a corner between the upstanding wall and the fixed table 5, and a panel 82 is attached to the upstanding wall in covering relation to the cavity 81, leaving a gap at a lowermost part of the cavity 81. The gap, which is the lowermost part of the cavity 81, provides a slit 80 which serves as each of the slits S1, S2. The slit 80 has a height small enough to pass one medal therethrough at a time (see FIG. 14). A bolt 83 is adjustably threaded in the upper surface of the fixed table 5 near the slit 80 and has a head projecting upwardly from the fixed table 5 by an adjusted distance.

When medals M (see FIG. 13) on the fixed table 5 move toward the slit 80, the upwardly projecting head of the bolt 83 causes the medals M (see FIG. 13) to be stacked in layers near the bolt 83 and hence the slit 80. At this time, only medals M in the lowermost layer are allowed to pass through the slit 80, as shown in FIG. 14. The player can collect medals on the fixed table 5 in a manner described later on, without noticing the presence of the slit 80.

The slit 80 also has a width small enough to pass one medal therethrough at a time, and is positioned in a relatively lower position compared with the viewpoint of the player. Consequently, the slit 80 looks as if it is almost fully covered with the panel 82 and concealed thereby from a view from the player. This also allows the player to collect medals on the fixed table 5 without noticing the presence of the slit 80. If the panel 82 doubles as a panel which carries the name of the medal game machine, then the player is less likely to recognize that the panel 82 is used to define the slit 80, and can collect medals on the fixed table 5 without noticing the presence of the slit 80.

As shown in FIGS. 4 and 5, the medal game machine also has four first medal chutes 40 disposed in the base 1*a*. The first medal chutes 40 are positioned on opposite sides of the fixed tables 5, and extend substantially parallel to the pusher table 6 obliquely downwardly toward the center of the base 1*a*. The first medal chutes 40 have upper ends fixed to the base 1*a*, and underlie the slits S1, S2 for receiving medals which drop from the fixed tables 5 through the slits S1, S2. The medal game machine further has a second medal chute 41 disposed below the lower ends of the first medal chutes 40 in the base 1*a*. The second medal chute 41 lies transversely across the first medal chutes 40 and extends obliquely downwardly toward one side of the base 1*a*.

A medal hopper 42 is mounted on the bottom of the base 1*a* below the lower end of the second medal chute 41. The medal hopper 42 serves to temporarily store medals flowing down and discharged from the second medal chute 41, and discharge a predetermined number of medals from the stored medals. The medal hopper 42 is of a known structure, and comprises a medal storage box for storing medals, a disk disposed in a lower portion of the medal storage box, and a drive motor for rotating the disk about its own axis. The disk has a plurality of medal reception holes each for receiving a medal. When the drive motor is energized, the disk is rotated to receive medals in the respective medal reception holes, and the medals received in the medal reception holes are forcibly pushed into an elevator shaft 43 (described later on). The above operation is repeated to discharge a predetermined number of medals from the hopper 42.

As shown in FIG. 4, the elevator shaft 43 extends upwardly from the medal hopper 42 to an upper hollow portion of the portal-shaped ornamental tower 1*d*. The elevator shaft 43 has a vertical passage defined therein for passing an array of medals upwardly therethrough. The elevator shaft 43 may comprise a pipe of rectangular cross section which defines therein an inner passage having a width slightly larger than the diameter of the medals and a depth slightly larger than the thickness of the medals. The first medal chutes 40 and the second medal chute 41, the medal hopper 42, and the elevator shaft 43 jointly serve as a medal retriever for retrieving medals dropped from the fixed tables 5.

The upper hollow portion of the portal-shaped ornamental tower 1*d* has a through hole 44 defined centrally in a lower wall thereof. A medal rail 45 extends from the upper end of the elevator shaft 43 to the through hole 44, and is slanted downwardly toward the through hole 44. The medal rail 45 has a groove (not shown) defined therein along which medals can roll down in a vertical plane toward the through hole 44. The medal rail 45 may be replaced with a trough or gutter for delivering medals by gravity into the through hole 44.

As shown in FIG. 4, a vertical pipe 46 which communicates with the through hole 44 extends downwardly from the through hole 44 through the support beam 1*c* and has a lower end which defines a medal supply opening positioned immediately above the turntable 4. The pipe 46 comprises a transparent hollow cylinder and is supported by the portal-shaped ornamental tower 1*d* and the support beam 1*c*. The pipe 46 houses therein a vertical pole 47 having an upper end positioned in the through hole 44 and a lower end extending downwardly beyond the lower end of the pipe 46 and fixed coaxially to the upper surface of the turntable 4. A plurality of elliptical plates 48 are secured to the pole 47 at vertically spaced intervals. Each of the elliptical plates 48 is obliquely attached to the pole 47 such that it looks circular when viewed from above. The elliptical plates 48 have upper and lower surfaces of mirror finish for reflecting light emitted from lamps 50 (see FIGS. 2 and 4) supported on the support beam 1*c*.

Operation of the medal game machine will be described below with reference to FIGS. 1 through 15.

As described above, the medal game machine according to the present invention can simultaneously be played by four players. However, it is assumed in the following description of its operation that only one player plays a medal game on the medal game machine for acquiring as many metals as possible.

A certain number of medals have been placed on the turntable 4 and the fixed tables 5 before the medal game machine is switched on. When the medal game machine is turned on by a power supply switch (SW) (see FIG. 15), the drive motors 12, 22 are energized by the controller 100 to rotate the turntable 4 in a predetermined direction at a normal low speed and move the pusher table 6 reciprocally over the fixed tables 5.

Then, the player inserts a medal into the corresponding medal insertion mechanism 30, and the inserted medal is supplied through the medal insertion mechanism 30 onto the corresponding fixed table 5. Depending on the state in which the medals are placed on the fixed table 5, the position of the pusher table 6, and the position in which the medal is supplied through the medal insertion mechanism 30 onto the fixed table 5 at this time, the supplied medal is pushed toward one of the medal acquisition openings 8 by the pusher table 6.

A medal or medals which are now positioned on an edge of the fixed table 5 drop into the medal acquisition opening 8 due to the inserted medal which has been pushed by the pusher table 6, move down the medal chute 32 into the medal outlet slot 31, and are acquired by the player.

A medal which is now positioned on an edge of the fixed table 5 is pushed up the upwardly slanted plate 71*a* of the cantilever 71 of the checker mechanism 70 by the following medals pushed by the pusher table 6. When the medal reaches the boundary between the upwardly and downwardly slanted plates 71*a*, 71*b* and is further pushed by the following medals, the medal slides down the downwardly slanted plate 71*b* due to gravity onto the medal carrier 72*a* of the gate plate 72. The medal carrier 72 is now angularly moved downwardly because of the weight of the medal, which then slides off the medal carrier 72 into the medal acquisition opening 8 and moves through the medal chute 32 into the medal outlet slot 31. At this time, the angularly moved gate plate 72 triggers the optical sensor 74 to issue a jackpot signal indicative of the start of a jackpot operation.

In response to the jackpot signal, the controller 100 processes data either randomly or according to preset rules to give the player a result "WIN" or "MISS". More specifically, the controller 100 supplies a command signal to the LED display elements of the corresponding display unit 33 to display numerals which increases or decreases successively in units of time. Alternatively, the display unit 33 may be controlled by the controller 100 to display successively changing random slot-machine numerals, a vertically moving numeral-bearing reel, or a rotating roulette. Then, the controller 100 randomly stops the successively changing numerals, the reel, or the roulette displayed by the LED display elements, and detects the numerals displayed by the LED display elements when they are stopped. If all the detected numerals displayed by the LED display elements are identical to each other, then the controller 100 determines that a jackpot is established, and starts a jackpot operation, giving the player the result "WIN".

When the jackpot operation is initiated, the drive motor 12 is energized to rotate the turntable 4 at a higher speed than the normal low speed. After the rotational speed of the turntable 4 has reached a predetermined high speed, the drive motors 64 of the gate mechanisms 60 are energized by the controller 100 to rotate their drive shafts 64*a* through a predetermined angle, swinging the movable gate plates 72 to open the recesses in the annular wall 61. Therefore, many medals placed on the turntable 4 are discharged from the turntable 4 through recesses in the annular wall 61 onto the fixed tables 5 under centrifugal forces. However, the bolts N on the turntable 4 prevent one layer of medals surrounded by the bolts N from being ejected off the turntable 4.

The jackpot operation or the result "WIN" may be available in a plurality of different levels. For example, different numbers of medals may be transferred from the turntable 4 onto the fixed tables 5 in the respective different levels of the jackpot operation or the result "WIN".

When the pusher table 6 is moved after those many medals have been discharged from the turntable 4 onto the fixed tables 5, many medals drop off the fixed tables 5 into the medal acquisition openings 8, allowing the player to win those many medals.

The gate mechanisms 60 in each pair are positioned symmetrically with respect to the horizontal line in FIG. 6, as described above. Consequently, depending on the position of the checker mechanism 70 which has issued the jackpot signal, the controller 100 controls the drive motor 12 to reverse the turntable 4 in a direction opposite to the predetermined direction.

Thereafter, the controller 100 controls the drive motor 12 to rotate the turntable 4 at the normal low speed in one direction or the other, and then controls the medal hopper 42 to supply a predetermined number of medals. The medal hopper 42 supplies the medals through the elevator shaft 43 and the medal rail 45 into the pipe 46. The medals drop through the pipe 46 while hitting the elliptical plates 48 on the pole 47 which is rotating in unison with the turntable 4, and then are discharged onto the turntable 4. Since the medals as they drop hit the elliptical plates 48, they produce such a jingling sound effect as to give the player the impression that many medals are being discharged onto the turntable 4. When the medals hit the elliptical plates 48, they also produce glittering reflections. Based on the jingling sounds and glittering reflections, the player is further motivated to acquire more medals.

If the detected identical numerals displayed by the LED display elements are in a certain numeral combination such as "777", then the controller 100 may first control the medal hopper 42 to supply a certain number of medals onto the turntable 4, and then initiate the jackpot operation.

Inasmuch as the turntable 4 is rotated at the high speed to discharge medals therefrom onto the fixed tables 5 under centrifugal forces and also medals are supplied from the pipe 46 onto the turntable 4, as described above, the medals are discharged from and supplied onto the turntable 4 in such a manner that has not been found on the conventional medal game machine and that gives the player visual and audio effects which tend to incite the player to win more medals.

The medal game machine according to the present invention offers various advantages described below.

Since medals are supplied onto the turntable 4 which is being rotated and thereafter transferred from the turntable 4 onto the fixed tables 5, the medals to be transferred onto the fixed tables 5 are displayed on the turntable 4 for the player to see. Therefore, the player is motivated by those medals on the turntable 4 to acquire more medals.

When a medal inserted through the medal insertion mechanism 30 by the player is supplied onto the fixed table 5, the medal changes the manner in which medals are pushed by the pusher table 6 for allowing the player to be interested in winning more medals.

A jackpot operation, once initiated, transfers many medals from the turntable 4 onto the fixed tables 5, giving the player a greater opportunity to get more medals. Therefore, an anticipation for the jackpot operation incites the player to acquire more medals.

When a medal moves up the upwardly slanted plate 71*a* and then down the downwardly slanted plate 71*b* across the boundary between these upwardly and downwardly slanted plates 71*a*, 71*b*, it causes the display unit 33 to start changing its displayed information, giving the player an exciting visual effect. Specifically, as the medal moves up the upwardly slanted plate 71*a* by being pushed by following medals on the fixed table 5, the player is thrilled by the possibility of the medal's slipping laterally off the upwardly slanted plate 71*a*. Then, once the medal moves beyond boundary between these upwardly and downwardly slanted plates 71*a*, 71*b*, it quickly slides down the downwardly slanted plate 71*b*, relieving the player and also rejoicing the player with a promised jackpot operation which will soon be started as clearly announced by the swinging movement of the flag plate 76.

After the jackpot operation, many medals are supplied from the pipe 46 onto the turntable 4. When those many medals drop through the pipe 46 onto the turntable 4, they make jingling sounds and glittering reflections which give the player such an illusion that more medals are supplied onto the turntable 4 than medals are actually supplied. Thus, the player is further motivated to win more medals.

The glittering reflections produced by the dropping medals give the player a visual effect which impels the player to acquire more medals.

The jingling sounds produced by the dropping medals also give the player an audio effect which incites the player to acquire more medals.

The medals placed on the outer circumferential portion of the turntable 4 are selectively transferred from the turntable 4 onto the fixed tables 5. Therefore, the number of medals placed and displayed on the turntable 4 is different from the number of metals that are actually transferred. As a result, the number of metals that are actually transferred is limited, while at the same time the player keeps expecting more medals to be acquired.

When medals are forcibly discharged from the turntable 4 onto the fixed tables 5 under centrifugal forces through the gate mechanisms 60 which are open, the player is given a visual effect that produces an illusion that more medals are supplied onto the fixed tables 5 than medals are actually supplied. Thus, the player is further motivated to win more medals.

When medals are stacked in layers on the fixed tables 5, only those medals in the lowermost layer pass through the slits S1, S2 and are retrieved by the medal retriever. Therefore, a certain number of medals can be received from the fixed tables 5 without being noticed by the player. As a result, the number of metals that are actually transferred is limited, while at the same time the player keeps expecting more medals to be acquired.

Although a certain preferred embodiment of the present invention has been shown and described in detail, it should be understood that various changes and modifications may be made therein without departing from the scope of the appended claims.

What is claimed is:

1. A metal game machine comprising:

a fixed table for placing medals thereon;

a medal acquisition opening defined alongside of said fixed table and communicating with a medal outlet slot accessible by a player;

pusher means for pushing a medal on said fixed table toward said medal acquisition opening;

supply means for supplying medals onto said fixed table;

medal detecting means disposed at a position spaced from an edge of said fixed table and disposed in said medal acquisition opening for detecting passage of a medal; and a cantilever extending from said edge of said fixed table into said medal acquisition opening, said medal detecting means being mounted on said cantilever.

2. A medal game machine according to claim 1, wherein said cantilever comprises:

a first slanted surface extending obliquely upwardly from said edge of the fixed table; and a second slanted surface extending obliquely downwardly from said first slanted surface;

said medal detecting means having a sensor for detecting a medal which passes on said second slanted surface.

3. A medal game machine according to claim 1, further comprising indicator means for indicating to the player the passage of the medal detected by said medal detecting means.

* * * * *